US006691473B1

(12) United States Patent
Mayle et al.

(10) Patent No.: US 6,691,473 B1
(45) Date of Patent: Feb. 17, 2004

(54) APPARATUS AND METHOD FOR SEALING A VERTICAL PROTRUSION ON A ROOF

(76) Inventors: Steven Robert Mayle, 2274 Augusta Dr., Fremont, OH (US) 43420; Robert L. Mayle, 2047 S. Hyde Rd., Fremont, OH (US) 43452

( * ) Notice: Subject to any disclaimer, the term of this patent is extended or adjusted under 35 U.S.C. 154(b) by 116 days.

(21) Appl. No.: 09/759,698

(22) Filed: Jan. 12, 2001

(51) Int. Cl.[7] ..... E04B 7/00; E04H 12/28

(52) U.S. Cl. ..... 52/198; 52/58; 52/96; 285/42; 285/424

(58) Field of Search ..... 52/96, 97, 60, 52/219, 58, 66, 199, 302.6, 465, 462, 463, 464, 59, 62, 198; 285/42, 424

(56) References Cited

U.S. PATENT DOCUMENTS

| | | | | |
|---|---|---|---|---|
| 1,012,219 A | | 12/1911 | Overton | 285/42 |
| 1,031,577 A | | 7/1912 | Overton | 285/42 |
| 1,080,159 A | | 12/1913 | Overton | 285/42 |
| 1,103,666 A | | 7/1914 | Fife | 285/42 |
| 1,594,932 A | | 8/1926 | Doyle | 285/42 |
| 1,678,715 A | | 7/1928 | Stephenson | 285/42 |
| 1,721,715 A | | 7/1929 | Schindler | 285/42 |
| 3,763,605 A | | 10/1973 | Freeman | 52/58 |
| 3,871,145 A | | 3/1975 | Hatmaker | 285/42 |
| 4,112,632 A | | 9/1978 | Simpson | 52/11 |
| 4,603,517 A | * | 8/1986 | Lyons, Jr. | 52/96 |
| 4,625,469 A | * | 12/1986 | Gentry et al. | 52/96 |
| 4,635,409 A | | 1/1987 | Vandemore | 52/60 |
| 4,652,321 A | | 3/1987 | Greko | 156/60 |
| 4,671,036 A | | 6/1987 | Sullivan | 52/518 |
| 4,799,986 A | | 1/1989 | Janni | 156/196 |
| 4,860,514 A | | 8/1989 | Kelly | 52/410 |
| 4,870,796 A | | 10/1989 | Hart et al. | 52/409 |
| 4,872,296 A | | 10/1989 | Janni | 52/58 |
| 5,027,572 A | | 7/1991 | Purcell et al. | 52/309.9 |
| 5,077,943 A | | 1/1992 | McGady | 52/58 |
| 5,218,793 A | | 6/1993 | Ball | 52/62 |
| 5,365,709 A | | 11/1994 | Lassiter | 52/408 |
| 5,452,553 A | | 9/1995 | Clapp et al. | 52/408 |

(List continued on next page.)

FOREIGN PATENT DOCUMENTS

| | | | | |
|---|---|---|---|---|
| DE | 3603303 | * | 2/1986 | E04D/13/14 |
| GB | 2027469 | * | 2/1980 | E04D/1/30 |

OTHER PUBLICATIONS

GenFlex Product Details for Field Fabricated Outside Corner.

Jan. 1, 1993, Technical product literature from Duro–Last, Inc.

Jan. 1, 1993, Technical product literature from Duro–Last, Inc.

*Primary Examiner*—Carl D. Friedman
*Assistant Examiner*—Chi Q Nguyen
(74) *Attorney, Agent, or Firm*—Standley Law Group LLP

(57) ABSTRACT

A pipe boot having a vertical portion adapted to surround a predetermined portion of the pipe to be covered, the vertical portion having a top end and a bottom end, wherein the top end has a top opening and wherein the bottom end has a bottom opening; a base portion, wherein the base portion is connected to a bottom edge of the vertical portion and wherein the vertical portion extends substantially in the vertical direction when the base portion resides on the roof. It is also preferred that the bottom opening of the boot be adapted to accept a pipe to be covered. The pipe boot may also be open to allow installation on existing pipes. In the preferred embodiment, the top end of the vertical portion has a slit, the slit running vertically down a predetermined distance of the vertical portion of the boot and wherein the slit allows the top opening of the vertical portion to be adjusted in size to fit around the pipe to be covered. The boot is installed by: placing the bottom opening of the vertical portion over a protrusion to be covered; placing the base portion flat over the roof; pulling a top portion of a side edge of the vertical portion around the pipe so that the top opening of the vertical portion is adjusted to fit the pipe; and sealing the top opening of the vertical portion around the pipe.

10 Claims, 4 Drawing Sheets

U.S. PATENT DOCUMENTS

| | | | | | |
|---|---|---|---|---|---|
| 5,706,610 | A | | 1/1998 | Mayle | 52/60 |
| 5,832,675 | A | * | 11/1998 | Zuares | 52/60 |
| 5,860,256 | A | * | 1/1999 | Humber | 52/219 |
| 5,946,863 | A | * | 9/1999 | Bullard | 52/58 |
| 5,983,592 | A | | 11/1999 | Mayle | 52/60 |
| 6,110,311 | A | * | 8/2000 | Mayle et al. | 52/58 |
| 6,374,549 | B1 | * | 4/2002 | Mayle | 52/58 |

* cited by examiner

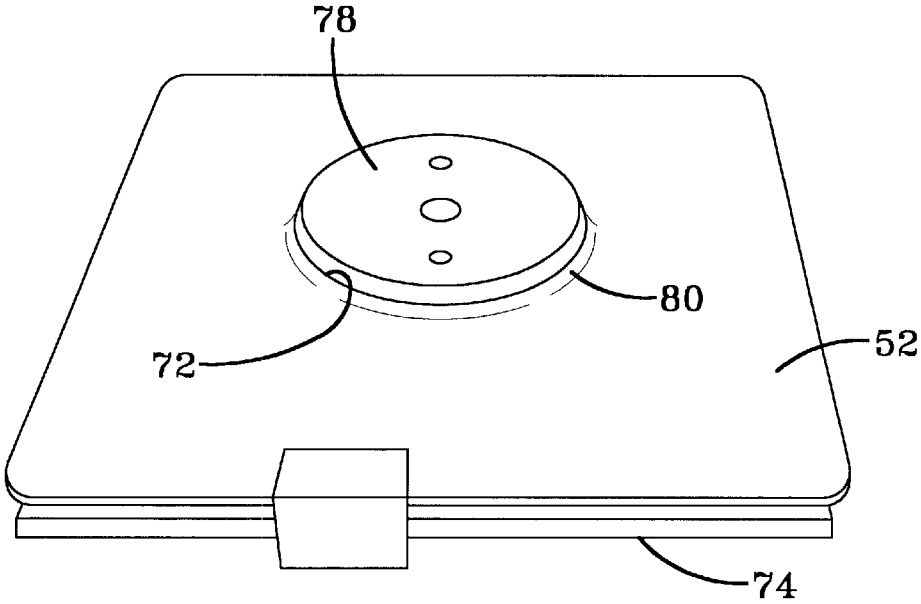
FIG-3
FIG-4
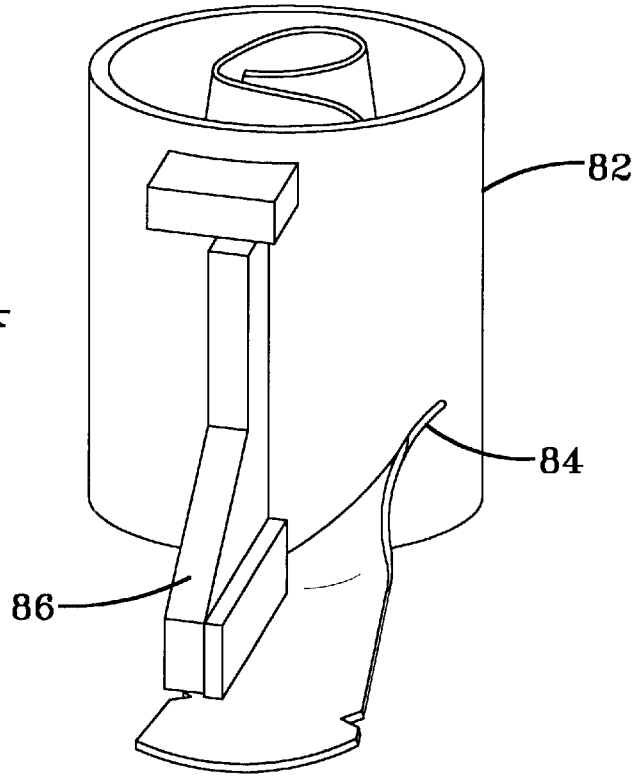

APPARATUS AND METHOD FOR SEALING A VERTICAL PROTRUSION ON A ROOF

BACKGROUND AND SUMMARY OF THE INVENTION

The present invention relates generally to roof-covering devices, and more particularly to a boot for covering and providing a water-tight seal around a protrusion on a roof.

Polymer coated membranes are commonly used to cover roofs. Often, the membrane is custom designed for the particular roof on which it is used. The roof measurements are provided to the factory which creates a unitary membrane from separate pieces which have been heat welded together.

Although these roofs are generally flat, there are frequently items protruding from the surface of the roof, such as vents, ductwork, air conditioning units, and the like. The size of these items should be provided to the factory so that accommodations can be made for them in the membrane. Locations of these items may also be provided to the factory where the cuts are made at the factory (e.g., not in the field).

The present invention specifically relates to a boot for covering and sealing a vertical protrusion (e.g., pipe) extending from a roof to be sealed. As discussed, when installing a roof membrane, it is desirable to provide a water-tight seal around protrusions in a roof. When installing a boot around a protruding pipe, generally three seals must be made to provide a water-tight seal around the pipe:

1.) a base portion of the boot should be sealed to a vertical portion of the boot (e.g. heat sealed);

2.) the base portion should be sealed to the roof or a roof membrane(e.g. heat sealed); and 3.) a top portion of the vertical portion of the boot should be sealed around the pipe to prevent water from entering any space between the boot and the pipe.

Currently this process of sealing a protruding pipe takes a relatively long time and often results in a poor seal. Accordingly, the present invention relates to a new method and apparatus for sealing vertical protrusions from a roof allowing the boot of the present invention to be easily installed and adjusted to provide a tight seal for protruding pipes of various diameters.

The boot of the present invention:

1.) allows easier and more cost-effective installation;

2.) allows sealing of pipes of various diameters; and

3.) provides tight seals to pipes of various diameters.

In addition to the features mentioned above, objects and advantages of the present invention will be readily apparent upon a reading of the following description.

The boot of the present invention is comprised of:

a base portion having an opening; a top portion attached to the base portion along the opening in the base portion; a break in the base portion and the top portion, the break in the base portion separating a first portion of the base portion from a second portion of the base portion, and wherein the break in the top portion separates a first portion of the top portion from a second portion of the top portion; and wherein the break allows the apparatus to be opened to accept a protrusion on the roof to be covered and wherein the first portions of the base portion and the top portion may be pulled around the protrusion and sealed to the second portions of the base portion and top portion, respectively. The first portions of the base portion and top portion may be adjustably pulled around the protrusion to accommodate protrusions of various sizes.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which:

FIG. 3 illustrates a base portion of a boot engaged to a bottom die piece;

FIG. 4 illustrates the top portion of FIG. 2 surrounded by a top die piece;

DETAILED DESCRIPTION OF PREFERRED EMBODIMENT(S)

Figure 1:
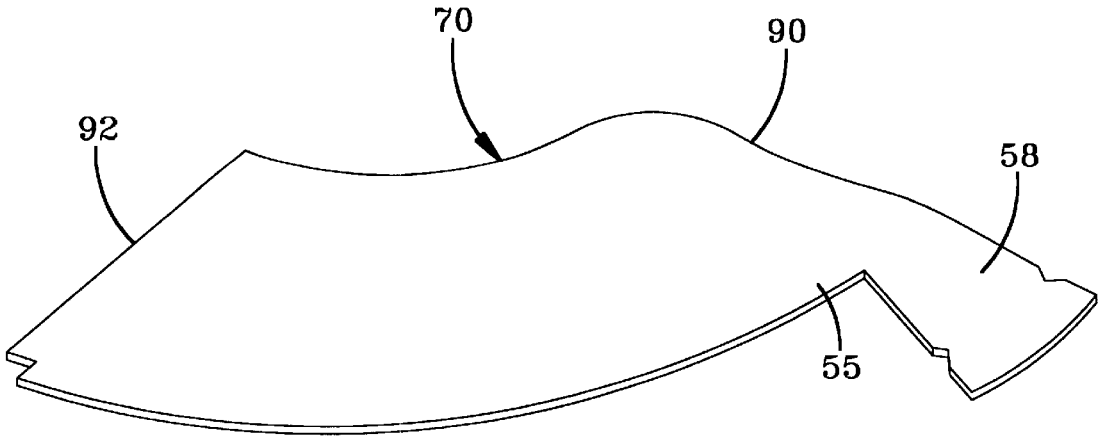
FIG. 1 illustrates one embodiment of a cut-out piece for an open boot embodiment.

The preferred system herein described is not intended to be exhaustive or to limit the invention to the precise forms disclosed. They are chosen and described to explain the principles of the invention, and the application of the method to practical uses, so that others skilled in the art may practice the invention.

The boot (or flashing) of the present invention is an open design. In other words, there is a slit or cut 54 in the top (or vertical) portion 50 of the boot. The base portion 52 of the boot is also cut 56 (slit 56 meets the slit 54 in the top portion) so that the boot may be opened to accept an existing vertical protrusion on the roof.

Figure 6:
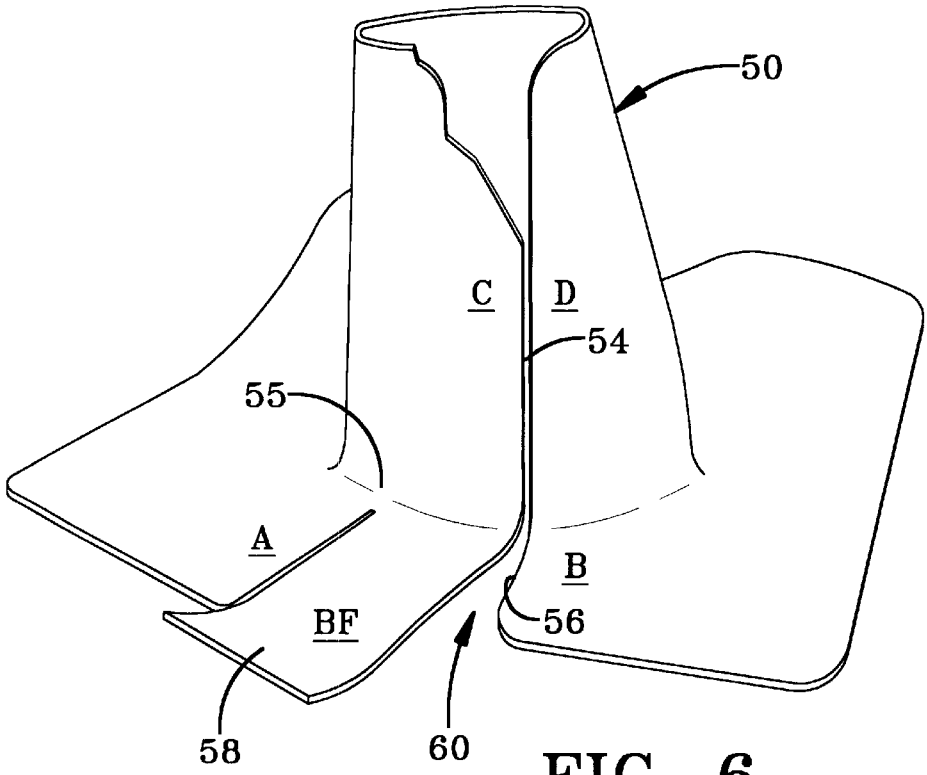
FIG. 6 illustrates one embodiment of an open boot of the present invention.

As illustrated in FIG. 6, the gap or divide 60, 61 in the boot separates the joint portions A, B, C, D of the boot. The break 60 in the base portion separates a first portion A of the base portion from a second portion B of the base portion. The break 61 in the top portion separates a first portion C of the top portion from a second portion D of the top portion.

A protrusion on the roof to be sealed is placed in the boot through the gap. As an initial step in sealing around the protrusion, the joint portion A is joined with joint portion B of the base. Joint portion C is joined with joint portion D.

The break 60, 61 in the boot allows the apparatus to be opened to accept a protrusion on the roof to be covered. The first portions A, C of the base portion and the top portion may be pulled around the protrusion and sealed to the second portions B, D of the base portion and top portion, respectively. In the preferred embodiment, the break 60 in the base portion is aligned with the break 61 in the top portion.

The boot also has a base flap (BF) 58 which is used to seal together base portions A and B. In one embodiment, the base flap is part of the overlap portion 66 (a more detailed description of the overlap portion is found below) that is used to bond or weld the two joint portions A and B together. In an alternative embodiment, the base flap is connected to another portion of the boot (e.g., base or non-overlapping portion). It is appreciated that there may be different size stacks for the various size pipes.

Figure 2:
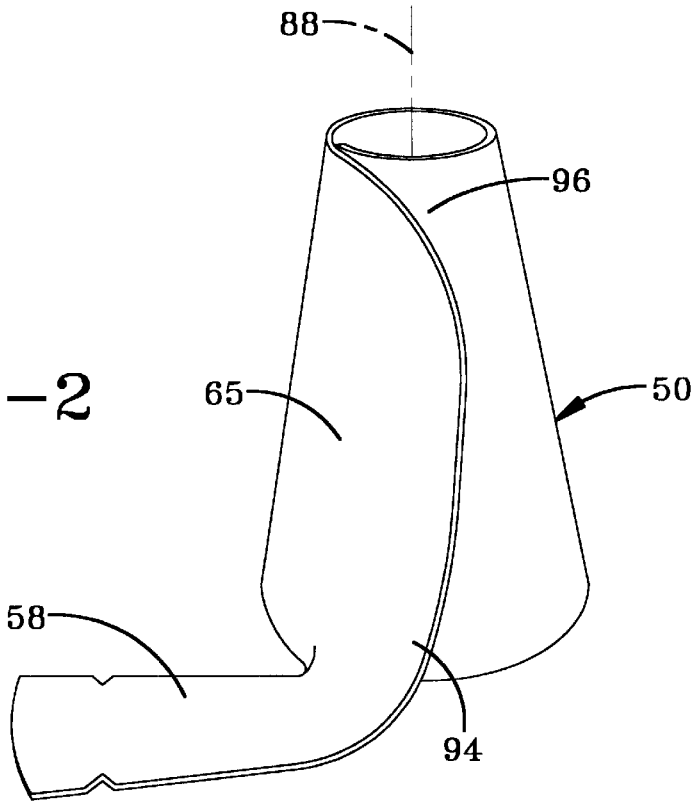
FIG. 2 illustrates one embodiment of a top portion of a boot.

FIG. 1 illustrates the cut-out flashing 70 that is formed into the top portion of the flashing. The cut-out is then formed into the top portion illustrated in FIG. 2. The top portion is welded together (at 65) with an overlapping portion 66 that extends past the weld. As discussed above, the base flap is preferably an extension of the overlapping portion. The base flap portion preferably extends from a bottom edge 55 of the top portion. In the assembled but uninstalled state (FIGS. 6 and 7), the base flap portion is preferably interposed between the first portion A of the base portion and the second portion B of the base portion.

The base of the flashing is then prepared by fitting the opening 72 in the base onto a bottom die 74. A portion of the base portion around the base opening, illustrated at 80, is fit around the die head 78 for welding to the top portion. See FIG. 3. The top portion of the flashing is then enclosed by a top die 82. See FIG. 4. The top die has a base flap slit 84 for engaging the base flap. The base flap is threaded through the slit and away from the weld juncture between the top portion and the base portion to ensure that the base flap does not get welded to other portions of the flashing. The top die also has a member 86.

The top die is then fitted onto the head of the bottom die so that the top portion is joined with the base portion, more particularly section 80 of the base portion. The top portion is then welded to the base portion.

A slit is then made in the base portion and top portion so that a gap or break is formed between portions A and B and portions C and D. In one embodiment, the slit is made along the vertical axis 88 along the weld portion 65 of the top portion of the flashing. It is appreciated that in an alternative method of manufacture, the gap between the joint portions may be preformed (i.e, without requiring a cut to be made after the welding of the top and base portions of the flashings).

Figure 7:
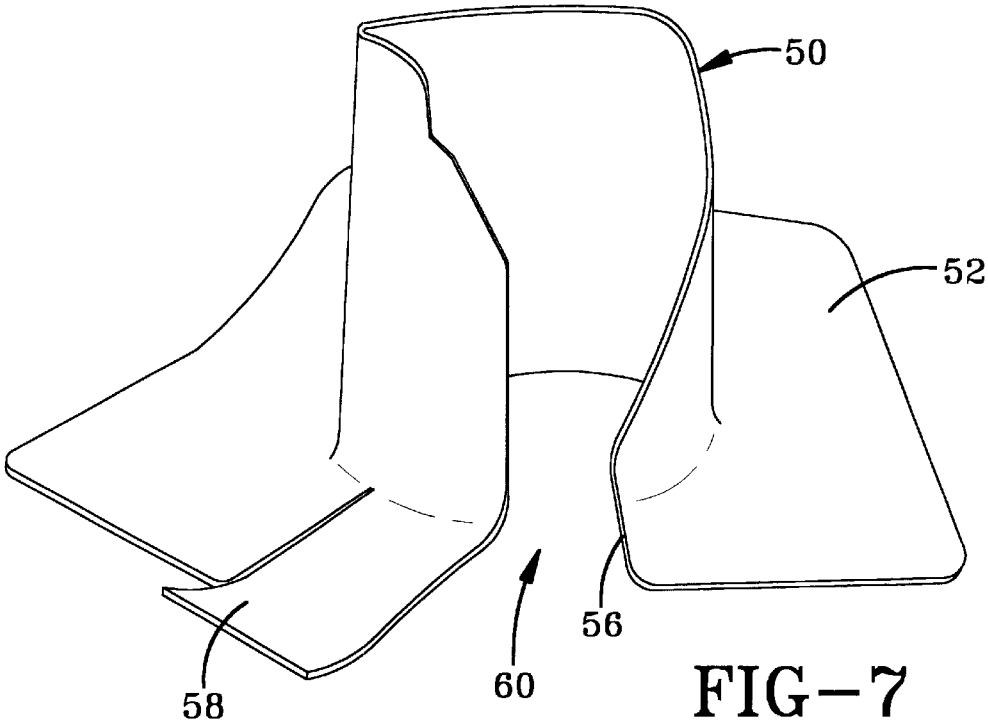
FIG. 7 illustrates another embodiment of an open boot of the present invention.

FIGS. 6 and 7 illustrate flashings of the present invention for sealing protrusions (e.g., vertical) of a roof. As illustrated in FIG. 6, in one embodiment, joint portion A was integral with joint portion B prior to being cut. During installation around a roof protrusion, the joint portion A is pulled toward the joint portion B. The base flap portion is then placed over, and welded to, the first portion A of the base portion and the second portion B of the base portion.

Figure 5:
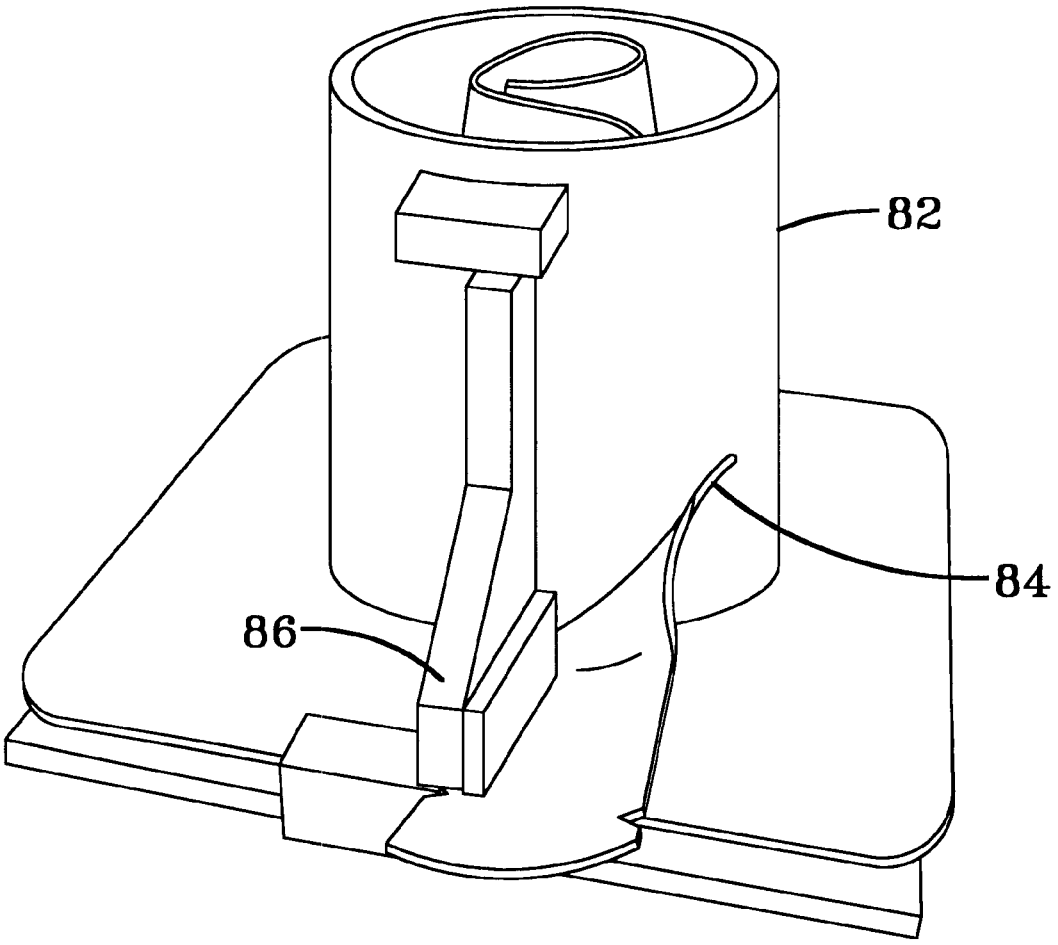
FIG. 5 illustrates the top die piece of FIG. 4 assembled with the bottom die piece of FIG. 3.

The open embodiment of the protrusion covering is preferably made by:

a.) preparing a cut-out (FIG. 1) having a first side edge 90 and a second side edge 92, the cut-out having a base flap portion extending from a bottom edge 55 along the first side edge;

b.) forming a top portion (FIG. 2) of the apparatus by overlapping a first portion 94 of the cut-out along the first side edge with a second portion 96 of the cut-out along the second side edge. The base flap portion preferably extends from the overlap portion 66;

c.) welding the first portion 94 with the second portion 96 at 65;

d.) sealing the top portion of the apparatus with a base portion except for the base flap portion (FIG. 5);

e.) cutting the base portion and top portion along the axis of the second edge of the top portion creating an opening in the apparatus for accepting a protrusion to be covered.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. An apparatus for covering a protrusion on a roof, said apparatus comprising:

a base portion adapted for sealing to said roof and having an opening for receiving said protrusion;

a top portion having an opening for receiving said protrusion, said top portion attached to said base portion such that said openings are substantially aligned;

a break in said base portion and said top portion, said break in said base portion separating a first portion of said base portion from a second portion of said base portion, and said break in said top portion separating a first portion of said top portion from a second portion of said top portion; and a base flap portion, wherein said break allows said apparatus to be opened to accept said protrusion;

wherein said first portions of said base portion and said top portion are adapted to be thereafter pulled toward said second portions of said base portion and said top portion, respectively, thereby allowing the size of one, or both, of said openings in said top portion and said base portion to be adjusted to best fit around said protrusion;

whereafter said first portions of said base portion and said top portion overlap and are properly positioned to be sealed to said second portions of said base portion and said top portion, respectively; and wherein said base flap portion is adapted to cover at least a portion of said first portion of said base portion and at least a portion of said second portion of said base portion upon installation.

2. An apparatus according to claim 1, wherein said first portions of said base portion and top portion are welded to said second portions of said base portion and top portion respectively.

3. An apparatus according to claim 1, wherein said top portion is cone-shaped.

4. An apparatus according to claim 1, wherein said break in said base portion is aligned with said break in said top portion.

5. An apparatus according to claim 1, wherein said first portions of said base portion and said top portion are the edges on one side of said break and wherein said second portions of said base portion and said top portion are the edges on the other side of said break.

6. An apparatus according to claim 1, wherein said base flap portion extends from a bottom edge of said top portion.

7. An apparatus according to claim 1, wherein said base flap portion is adapted to be welded over said first and second portions of said base portion.

8. An apparatus according to claim 1, wherein said base flap portion extends from a bottom edge of said top portion interposed between said first portion of said base portion and said second portion of said base portion.

9. An apparatus for covering a protrusion on a roof, said apparatus comprising:

a base portion adapted for sealing to said roof and having an opening for receiving said protrusion;

a top portion having an opening for receiving said protrusion, said top portion attached to said base portion such that said openings are substantially aligned;

a break in said base portion and said top portion, said break separating a first portion of said base portion and said top portion from a second portion of said base portion and said top portion, said break further allowing said apparatus to be opened to accept said protrusion; and a base flap;

wherein said first portion of said top portion is adapted to be, after installation of said apparatus to said protrusion, pulled toward and over said second portion of said top portion and sealed thereto;

wherein said first portion of said bottom portion is adapted to be, after installation of said apparatus to said protrusion, pulled toward and over said second portion of said bottom portion and sealed thereto; and wherein said base flap is adapted to be thereafter welded over a seam created by the overlap of said first and second portions of said base portion.

10. An apparatus according to claim 9, wherein said base flap portion extends from a bottom edge of said top portion interposed between said first portion of said base portion and said second portion of said base portion.

* * * * *

US006691473C1

(12) EX PARTE REEXAMINATION CERTIFICATE (9128th)

United States Patent
Mayle et al.

(10) Number: US 6,691,473 C1
(45) Certificate Issued: Jul. 10, 2012

(54) APPARATUS AND METHOD FOR SEALING A VERTICAL PROTRUSION ON A ROOF

(75) Inventors: Steven Robert Mayle, Fremont, OH (US); Robert L. Mayle, Fremont, OH (US)

(73) Assignee: Custom Seal, Inc., Fremont, OH (US)

Reexamination Request:
No. 90/012,033, Dec. 2, 2011

Reexamination Certificate for:

| | |
|---|---|
| Patent No.: | **6,691,473** |
| Issued: | **Feb. 17, 2004** |
| Appl. No.: | **09/759,698** |
| Filed: | **Jan. 12, 2001** |

(51) Int. Cl.
*E04B 7/00* (2006.01)
*E04H 12/28* (2006.01)

(52) U.S. Cl. ..... 52/198; 52/58; 52/96; 285/42; 285/424

(58) Field of Classification Search ..... None
See application file for complete search history.

(56) References Cited

To view the complete listing of prior art documents cited during the proceeding for Reexamination Control Number 90/012,033, please refer to the USPTO's public Patent Application Information Retrieval (PAIR) system under the Display References tab.

*Primary Examiner*—Russell Stormer

(57) ABSTRACT

A pipe boot having a vertical portion adapted to surround a predetermined portion of the pipe to be covered, the vertical portion having a top end and a bottom end, wherein the top end has a top opening and wherein the bottom end has a bottom opening; a base portion, wherein the base portion is connected to a bottom edge of the vertical portion and wherein the vertical portion extends substantially in the vertical direction when the base portion resides on the roof. It is also preferred that the bottom opening of the boot be adapted to accept a pipe to be covered. The pipe boot may also be open to allow installation on existing pipes. In the preferred embodiment, the top end of the vertical portion has a slit, the slit running vertically down a predetermined distance of the vertical portion of the boot and wherein the slit allows the top opening of the vertical portion to be adjusted in size to fit around the pipe to be covered. The boot is installed by: placing the bottom opening of the vertical portion over a protrusion to be covered; placing the base portion flat over the roof; pulling a top portion of a side edge of the vertical portion around the pipe so that the top opening of the vertical portion is adjusted to fit the pipe; and sealing the top opening of the vertical portion around the pipe.

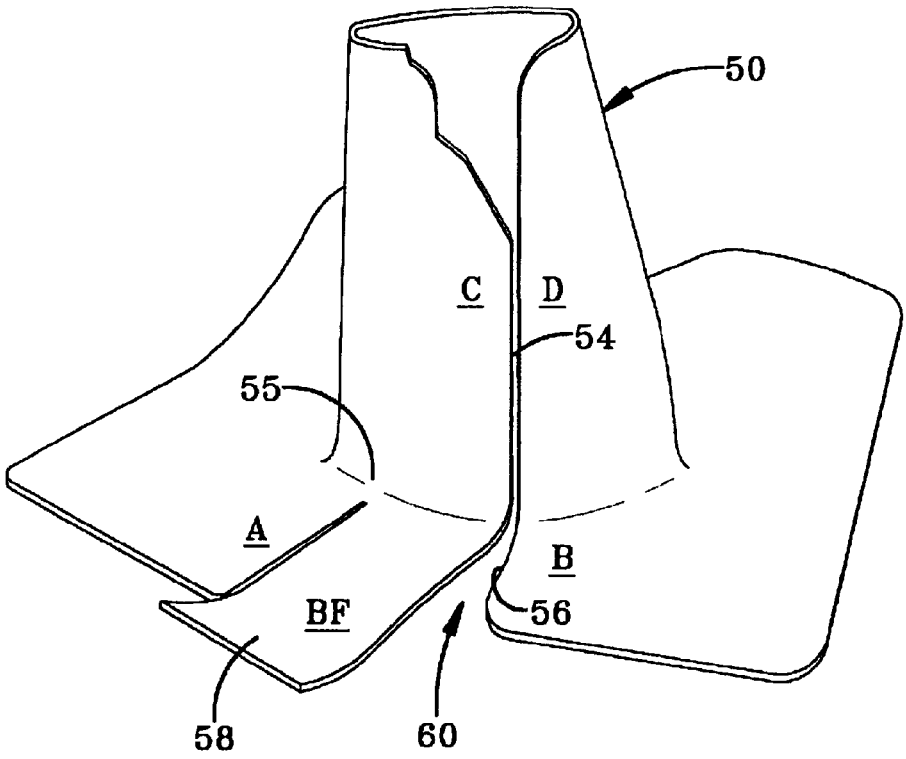

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 9 are determined to be patentable as amended.

Claims 2-8 and 10, dependent on an amended claim, are determined to be patentable.

1. An apparatus for covering a protrusion on a roof, said apparatus comprising:

a base portion adapted for sealing to said roof and having an opening for receiving said protrusion;

a top portion having an opening for receiving said protrusion, said top portion attached to said base portion such that said openings are substantially aligned;

a break in said base portion and said top portion, said break in said base portion separating a first portion of said base portion from a second portion of said base portion, and said break in said top portion separating a first portion of said top portion from a second portion of said top portion; and a base flap portion, *said base flap and said top portion are formed of a single-piece of material;* wherein said break allows said apparatus to be opened to accept said protrusion;

wherein said first portions of said base portion and said top portion are adapted to be thereafter pulled toward said second portions of said base portion and said top portion, respectively, thereby allowing the size of one, or both, of said openings in said top portion and said base portion to be adjusted to best fit around said protrusion;

whereafter said first portions of said base portion and said top portion overlap and are properly positioned to be sealed to said second portions of said base portion and said top portion, respectively; and wherein said base flap portion is adapted to cover at least a portion of said first portion of said base portion and at least a portion of said second portion of said base portion upon installation.

9. An apparatus for covering a protrusion on a roof, said apparatus comprising:

a base portion adapted for sealing to said roof and having an opening for receiving said protrusion;

a top portion having an opening for receiving said protrusion, said top portion attached to said base portion such that said opening are substantially aligned;

a break in said base portion and said top portion, said break separating a first portion of said base portion and said top portion from a second portion of said base portion and said top portion, said break further allowing said apparatus to be opened to accept said protrusion; and a base flap, *said base flap and said top portion are formed of a single-piece of material*;

wherein said first portion of said top portion is adapted to be, after installation of said apparatus to said protrusion, pulled toward and over said second portion of said top portion and sealed thereto;

wherein said first portion of said bottom portion is adapted to be, after installation of said apparatus to said protrusion, pulled toward and over said second portion of said bottom portion and sealed thereto; and wherein said base flap is adapted to be thereafter welded over a seam created by the overlap of said first and second portions of said base portion.

* * * * *